United States Patent [19]

Spore

[11] 4,332,648

[45] Jun. 1, 1982

[54] ELECTROLYTIC APPARATUS FOR THE MANUFACTURE OF ALKALI METAL HALATE

[75] Inventor: Everette M. Spore, Tonawanda, N.Y.

[73] Assignee: Hooker Chemicals & Plastics Corp., Niagara Falls, N.Y.

[21] Appl. No.: 144,010

[22] Filed: Apr. 28, 1980

Related U.S. Application Data

[63] Continuation-in-part of Ser. No. 104,231, Dec. 17, 1979.

[51] Int. Cl.[3] ..... C25B 1/26; C25B 15/08; C25B 9/00

[52] U.S. Cl. ..... 204/95; 204/128; 204/239; 204/270; 204/278; 204/274

[58] Field of Search ..... 204/237, 239, 267–269, 204/270, 274, 275–278, 95, 128

[56] References Cited

U.S. PATENT DOCUMENTS

| | | | |
|---|---|---|---|
| 2,204,506 | 6/1940 | MacDougall | 204/5 |
| 3,385,779 | 5/1968 | Nishiba et al. | 204/272 |
| 3,451,906 | 6/1969 | Weed | 204/95 X |
| 3,463,722 | 8/1969 | Westerlund | 204/268 |
| 3,518,180 | 6/1970 | Grotheer | 204/268 |
| 3,539,486 | 11/1970 | Fleck | 204/237 X |
| 3,679,568 | 7/1972 | Westerlund | 204/95 X |
| 3,732,153 | 5/1973 | Harke et al. | 204/95 |
| 3,756,933 | 9/1973 | Greenberg | 204/237 X |
| 3,766,044 | 10/1973 | Westerlund | 204/268 |
| 3,785,951 | 1/1974 | Fleck | 204/268 |
| 3,819,503 | 6/1974 | Casson et al. | 204/270 X |
| 3,884,791 | 5/1975 | Raetzsch et al. | 204/268 |
| 3,902,985 | 9/1975 | Raetzsch et al. | 204/268 |
| 3,919,059 | 11/1975 | Raetzsch et al. | 204/95 X |
| 3,997,414 | 12/1976 | Casson et al. | 204/278 X |
| 4,039,420 | 2/1977 | Nawrot | 204/242 |
| 4,046,653 | 9/1977 | de Nora et al. | 204/95 |
| 4,087,344 | 5/1978 | Casson et al. | 204/278 X |
| 4,134,805 | 1/1979 | Frohler et al. | 204/95 X |
| 4,194,953 | 3/1980 | Hatherly | 204/275 X |
| 4,218,293 | 8/1980 | Nawrot | 204/269 X |

FOREIGN PATENT DOCUMENTS

| | | | |
|---|---|---|---|
| 1956156 | 2/1971 | Fed. Rep. of Germany | 204/275 |

*Primary Examiner*—Delbert E. Gantz
*Assistant Examiner*—Donald R. Valentine
*Attorney, Agent, or Firm*—Howard M. Ellis

[57] ABSTRACT

An improved electrolytic apparatus for the production of an alkali metal halate, such as sodium chlorate, from an aqueous solution of alkali metal halide, such as sodium chloride, includes modular, vertical anodes and cathodes in alternating relationship in a housing, and an upwardly oriented flow directing funneling chimney structure in a cylindrical shaped housing and over the electrodes, through which, electrolyte between the electrodes rises, passing from a wider portion of the funnel to a narrower part thereof, and a connected chimney passageway, from which it is returned from recirculation to a location below the electrodes after removal of gas from it. Different structures of the electrolytic apparatus or cell are specifically disclosed in one of which the electrolyte, after having passed through the funnel structure, moves longitudinally with respect to the cell, and in the other of which it moves transversely. Also disclosed are alternate embodiments of the apparatuses of the types mentioned which include heat exchangers and a plurality of the described funnel devices. Methods for the manufacture of alkali metal chlorate by utilization of such apparatuses are also described. Additionally, several improvements in electrode structures, joinders of electrodes to conductors, spacings of electrodes and sealings of electrodes, conductors and cell parts are illustrated.

15 Claims, 6 Drawing Figures

ELECTROLYTIC APPARATUS FOR THE MANUFACTURE OF ALKALI METAL HALATE

CROSS REFERENCE TO RELATED APPLICATION

This application is a continuation-in-part of Ser. No. 104,231, filed Dec. 17, 1979.

This application relates to the manufacture of alkali metal halates, specifically sodium chlorate. More particularly, it relates to making sodium chlorate in a new and improved apparatus and by a new and improved process wherein the efficiency of electrolysis is improved, chemical conversion of caustic and chlorine to hypochlorite and subsequent conversion of that to chlorate are promoted and the undesirable and less efficient electrolytic production of chlorate and oxygen is inhibited.

Electrolytic cells for the manufacture of chlorine and sodium hydroxide from brine are well known. In such cells chlorine is produced at the anode and sodium hydroxide is manufactured at the cathode. Because chlorine and sodium hydroxide react chemically to produce sodium hypochlorite, in chlorine cells membranes or diaphragms or other suitable separating means are interposed between the electrodes to prevent such reactions. In chlorate cells, on the other hand, the chlorine produced at the anode is absorbed by the electrolyte and subsequently hydrolyzed to yield hypochlorous acid. The hypochlorous acid then equilibrates, $HOCl \rightleftarrows H^+ + ClO^-$, which, in the sodium chlorate reaction, yields sodium hypochlorite when reacted in the presence of the products of the cathode, e.g. hydroxyl ions. The hypochlorous acid then reacts with the sodium hypochlorite to yield sodium chlorate and hydrogen product(at the cathode). The conversion of the hypochlorous acid and hypochlorite to chlorate is normally not speedy enough to allow the complete production of chlorate without recirculation, and therefore, recirculation of the electrolyte is affected. Electrochemical formation (as opposed to chemical) of chlorate is also known, but is only a small portion of the chlorate which is formed chemically and also produces an inefficiency, oxygen, as a by-product of the electrochemical reaction. Also retention of such electrolyte containing unreacted hypochlorite in a non-electrolytic area wherein the speed of movement of the electrolyte is diminished is often desirable to give time for conversion of hypochlorite and hypochlorous acid to chlorate. In some cases the electrolyte containing the hypohalite is withdrawn from the cell apparatus and maintained at proper reaction conditions for halate formation in a retaining tank or reactor external to the cell, from which it is subsequently fed back to the cell for further reaction to increase the hypohalite (and halate) concentration thereof. However, it is often considered preferable for chlorate cells to be complete in themselves without the need for the supplementary external processing vessels, and it has been found to be desirable for the electrolysis of the brine and the chemical reactions of chlorine, hypochlorous acid and of hypochlorite to be conducted within the body of the electrolytic apparatus.

In accordance with the present invention an improved electrolytic apparatus for the production of alkali metal halate therein from an electrolyte, which is an aqueous solution of an alkali metal halide, comprises a housing with the lower section containing a plurality of side entering, upwardly and parallelly oriented anodes and cathodes in alternating relationship in such housing, such that the products of electrolysis at the anodes and cathodes are in contact in the electrolyte and between the electrodes where they can react to form hypohalite; an upwardly oriented flow directing funneling chimney structure located in the upper section of a substantially cylindrical shaped housing, said chimney structure positioned over such electrodes and narrowing to a passageway, through which the hypohalite-containing electrolyte from between such alternating anodes and cathodes rises due to the lifting power of hydrogen generated between pairs of such electrodes during electrolysis of the alkali metal halide solution. The hypohalite-containing electrolyte while in the passageway mixes. The improved apparatus includes means for removing from the interior of the housing at the top thereof at least a portion of the hydrogen generated and passed through the passageway; return means within the housing for slowing the flow of electrolyte from which hydrogen has been at least partially removed, so that hypohalite is converted to halate, and for returning said electrolyte, containing halate, to the bottom of the unit cells, for subsequent upward movement through them. Also within the invention are means for controlling the temperature of electrolyte, improved sealing and spacing aspects of the invention and an assembly of a plurality of sets of side entering electrodes, preferably in modular form, plus funneling chimney structures in a single cell housing. A method for manufacturing halates, using an apparatus of the invention, is another aspect thereof.

The foregoing features provide for an optimal performing low current density electrolytic cell for making alkali metal halates which performance is manifest by reduced power consumption through optimally close anode-cathode gap tolerances which provide for lower cell voltages; entry of both vertically positioned anodes and cathodes through the cells front and rear walls together with the electrodes preferred modular design enabling easy access for fast servicing to minimize costly down-time whenever electrodes require recoating; advanced design of the cell greatly simplifies construction such that minute tolerances can be met without the usual time consuming methods of renewal construction or fabrication; statistical reduction in risk of cell leakage occurances by a concomitant reduction and elimination of anode end and flange coverplate seals and optimization of electrolyte velocity to minimize "IR" heat and cell voltage by utilizing the riser principle of pumping action of hydrogen gas evolved at the electrodes.

In searches made in the U.S. Patent and Trademark Office for art relevant to the invention described herein, including the several aspects thereof, among the more relevant patents found were the following: U.S. Pat. Nos. 2,204,506*; 3,385,779, 3,451,906; 3,463,722*; 3,518,180; 3,539,486*; 3,679,568; 3,732,153*; 3,766,044; 3,785,951; 3,819,503; 3,884,791; 3,902,985; 3,919,059; 4,046,653*; and 4,134,805. The most relevant of these patents are those marked with asterisks, which are discussed below.

U.S. Pat. No. 2,204,506, at column 1, lines 33–46, recognizes the fact that hydrogen produced in the electrolysis of brine serves to promote upward circulation of electrolyte, which is considered to be desirable. U.S. Pat. No. 3,463,722 discloses flow rates of electrolytes past bipolar electrodes. U.S. Pat. No. 3,539,486 describes a cell having hydrogen bubbles which maintain intra-cell circulation of electrolyte at desired velocities, but the patent teaches use of an external reactor for the production of chlorate from hypochlorite. U.S. Pat. No. 3,732,153, assigned to the assignee of the present invention, teaches the lifting of electrolyte past electrodes by gaseous hydrogen produced in the electrolysis of brine, and at column 5, line 34–41, it is mentioned that an advantage in having individual vertically directed passages above the electrode pairs is that such circulate electrolyte most rapidly in those areas where the most gas is being generated (where the reaction is proceeding at the greatest rate). Finally, U.S. Pat. No. 4,046,653 teaches the importance of high speed circulation of electrolyte past the bipolar electrodes thereof. This patent mentions that prior art apparatuses adopted Venturi connections to avoid counter-recirculation effects of sluggish motion but the patent also mentions that such connections result in higher hydraulic energy losses in the circuit and reduce the electrolyte speed in the electrolysis gap. In summary, the various most relevant patents mentioned recognize that slow passage of electrolyte through the electrolysis gap results in electrolytic chlorate production, oxygen development and loss of efficiency. None of the patents describes the present embodiments of the invention wherein a reducing or funneling chimney-type of structure is employed to promote desirable electrolyte flow in the cell so that the electrolyte made is mixed thoroughly soon after electrolysis, without severe back pressure being generated, and wherein chlorate is chemically produced from hypochlorite and hypochlorous acid in the portions of the cell wherein electrolyte movement is intentionally slowed.

The invention will be readily understood by reference to the description in this specification, especially that following when taken in conjunction with the drawing, in which:

FIG. 1 is a perspective view of the interior of an apparatus of the present invention demonstrating electrolyte circulation pattern with electrodes and funneling chimney portion shown, with parts of the apparatus housing being illustrated in phantom to show the location thereof with respect to the electrodes and the funneling chimney, and some of the electrodes being removed for clarity of illustration;

Figure 1:
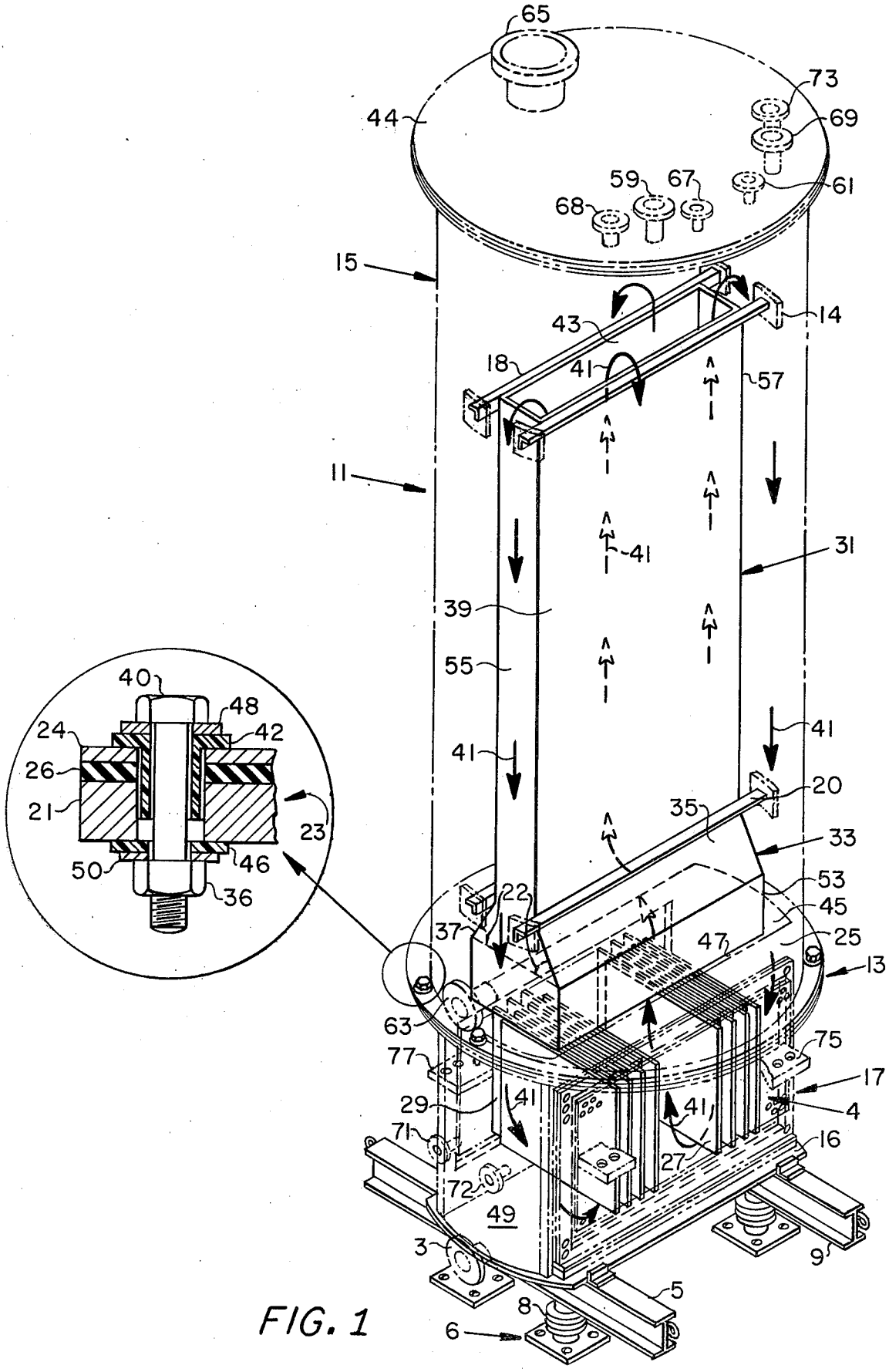
Figure 2:
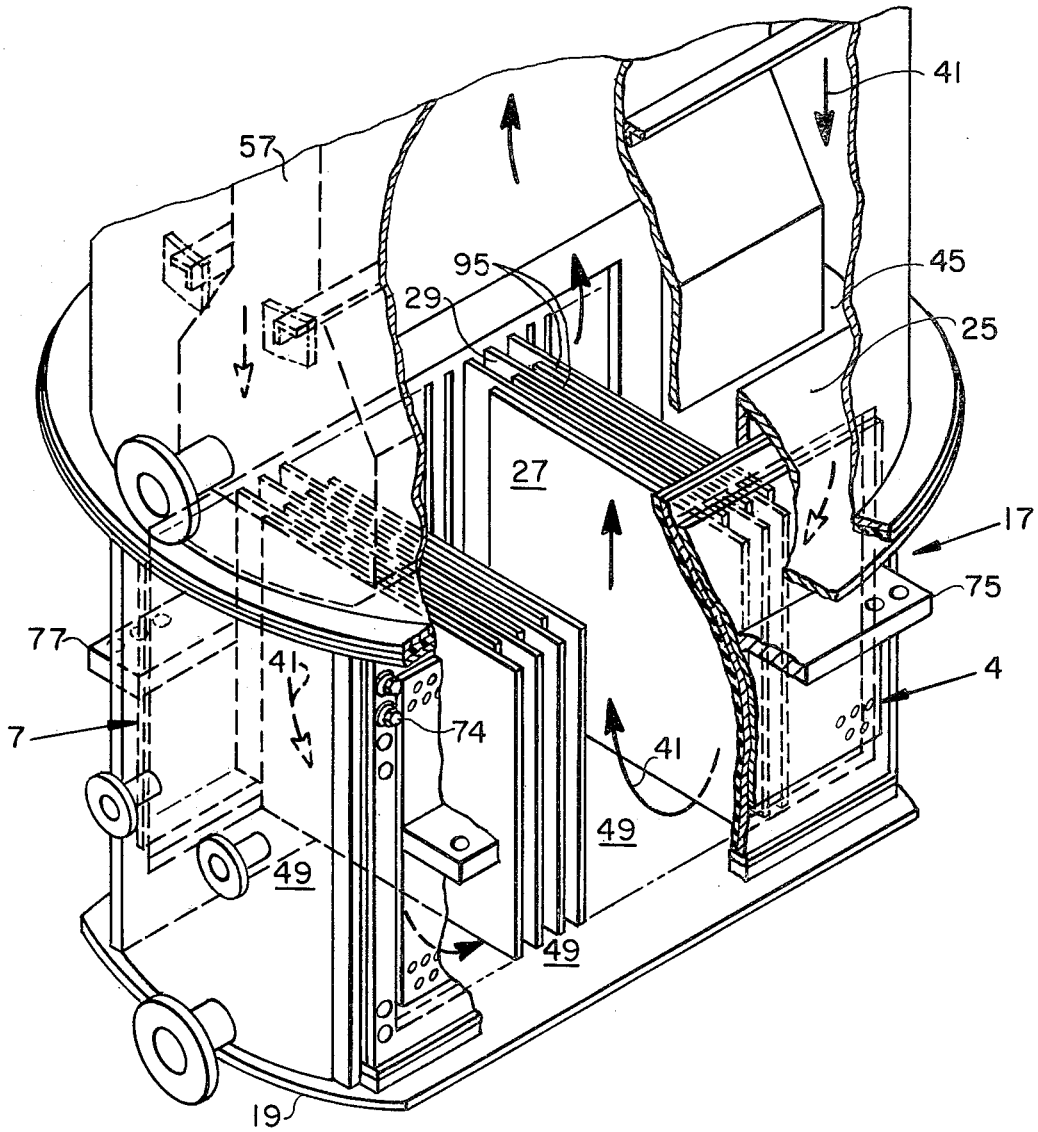
FIG. 2 is an enlargement of the lower section of the cell illustrating the electrode arrangement of the apparatus of FIG. 1.

In FIG. 1 electrolytic cell apparatus 11 is illustrated. This apparatus includes a housing 13, comprised of upper and lower sections 15 and 17. Upper section 15 is tubular and substantially cylindrical in shape. By contrast, lower section 17 of the housing 13 is substantially rectangular in shape except for the oval side walls which are shown only in the phantom to highlight the internal configuration of electrodes. The front and rear portions of the lower housing are substantially planar to accommodate anode and cathode assemblies 4 and 7 (FIG. 2). The upper and lower sections of the housing are joined together as shown at 23 (exploded view). Upper section flange 24 of housing 15 is joined to lower section flange 21, the latter being the outer periphery of aperature plate 25, said plate being welded to the upper ends of the sidewalls of the lower housing section, best illustrated in FIG. 2. For a liquid tight seal gasket 26 is disposed between the lower and upper flanges and secured with bolts, nuts, and washers 40, 36, 48 and 50. Electrical insulators 42 and 46 are employed as illustrated. Bottom plate 16 is welded to the lower ends of the side-walls of the lower housing section. Base support for apparatus 11 may, for example, consist of a plurality of beams 5 and 9, and a plurality of legs 6 equipped with electrical insulators 8.

Figure 3:
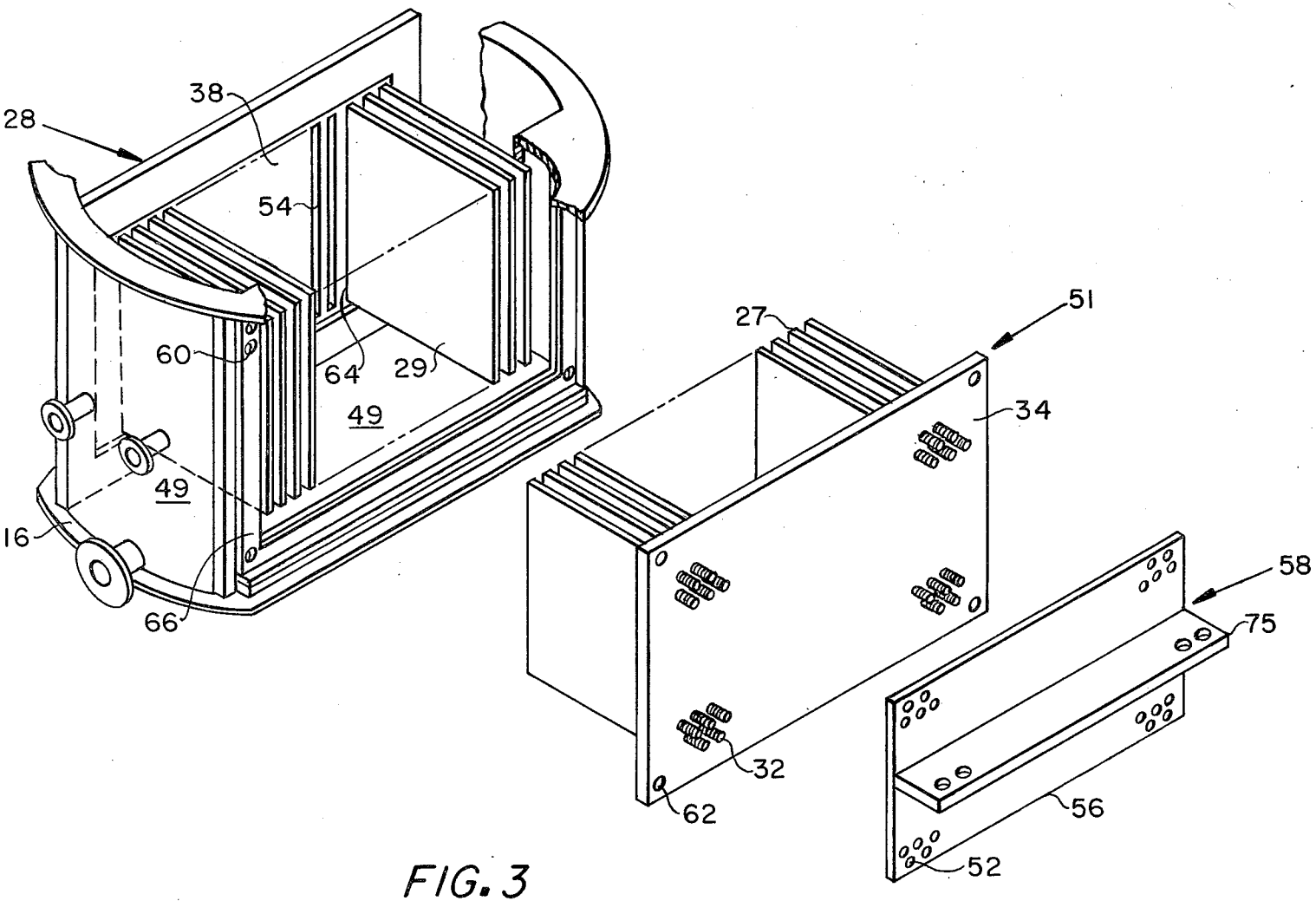
FIG. 3 is a perspective view of the component parts making up an anode module of the apparatus of FIG. 1.

Within the apparatus there are shown pluralities of anodes 27 and cathodes 29, arranged in pairs, with clearance spaces between them. It will be noted that anodes 27 are of generally thin, flat, rectangular shape and extend transversely with respect to the longitudinal vertical axis of the apparatus, as do cathodes 29, which are of similar shape. Both anodes 27 and cathodes 29 are in electrical contact with vertical wall members, and are side-entering for convenient servicing with minimal down-time. As best illustrated in FIG. 3 removal of bus assembly 58 (anode) and backplate 34 will provide easy access to the electrodes. The pairs of electrodes are spaced apart at distances for the lowest operating cell voltages, and efficient removal of electrolytic products upwardly between them, due to the rapid upward flow of generated hydrogen, and to a lesser extent, chlorine.

Above the plurality of upwardly and parallel oriented pairs of anodes and cathodes, in alternating relationship in the housing is a funneling chimney structure 31, comprising a lower funneling portion 33 extending over all the electrodes and which narrows down at front portion 35 and at back 37 to a reduced passage 39, which is of a uniform rectangular cross-sectional area and rises to near the top of the apparatus. The front and rear sections 35 and 37 are narrowed down at angles 22, which narrowing is sufficient to maximize hydrogen gas lift flow. The riser angles 22 most conducive to optimum gas lift are greater than 45°, and most preferably, between 45° and 95°. Although the apparatus will perform satisfactorily at angles other than specified above, the specific range given will promote miximum use of gas lift, i.e . . . minimize drag. Funneling chimney 31 fits over an opening in plate 25, which opening, better illustrated in FIG. 2, apparent from the upwardly directed flow arrows, permits the flow of electrolyte upwardly from between the electrodes, through the funneling chimney and out the top thereof in the direction illustrated by flow arrows 41 at that location. Funneling chimney structure 31 is rigidly supported over the electrodes by a plurality of upper and lower chimney supports 18 and 20. Supports 18 and 20 may be either permanently affixed to the chimney structure by welding or detachably mounted by bolting means. Supports 18 and 20 are mounted to the interior side-walls of housing 15 through support pads 14. So as to obtain best flow it is desirable for the clearance area at the open top 43 of the funneling chimney 31 and the housing top 44 at least to equal the open cross-sectional area of such open top at such location, so as to avoid the creation of an undesirable back pressure which could limit the flow of electrolyte and hydrogen past the electrodes. Also, the cross-sectional area of the passage portion of the funneling chimney is desirably 10 to 40%, e.g., 20%, of the greatest cross-sectional area of the funnel portion.

It will be seen that, due to the structure of the funneling chimney, electrolyte-hydrogen mixture, containing hypochlorite and chlorate, for example, spills over from the top of the chimney and moves down the front, back and ends of the chimney passageway (the downcomer) and toward the apparatus ends, in directions that have significant longitudinal components, so that it may flow through opening 45 and 47 at the two sides, front and rear sections in plate 25. The electrolyte-product mix next passes inwardly toward the middle of the apparatus through clearance 49, a space beneath the electrodes, and upwardly between them, through the funneling chimney, etc. Very preferably, the funneling chimney is located adjacent to plate 25 in such manner that all the electrolyte-gas mixture rising between the electrodes must pass upwardly through the funneling chimney and so that none of the electrolyte-product mix moving downwardly can pass in such direction between the electrodes. In other words, no undesirable conflicting flows of recycling electrolyte containing halate product with upwardly moving electrolyte-gas mixture result and the electrolyte-product and electrolyte-gas-product mixtures follow predictable and designed paths. In FIG. 1 a vertical flange 53 is shown at the bottom of the funneling chimney but such, while desirable, is not necessary.

Various openings in the apparatus walls, for feeding materials to the apparatus, for removing materials from it and for various auxiliary purposes, will now be described. Inlets 59 and 61 at housing lid 44 are for addition of brine to the cell, and outlet 63 at the lower portion of housing 15 is for removal of product, including sodium chlorate, some sodium chloride and a minor quantity of sodium hypochlorite. Gas is taken off from the cell through outlet 65 (such gas includes hydrogen and may also include small proportions of chlorine, carbon dioxide, oxygen and nitrogen). Opening 67 is for inert gas purging, as with nitrogen and opening 69 is an auxiliary or emergency opening for the same purpose. At openings 71 and 72 access is provided for connection of internal temperature and level indicators, not shown. Opening 3 is for draining the cell. Openings 68 and 73 are spare nozzles which may be utilized for removal of gaseous products or for addition of electrolyte, modifying chemicals, recycle of hydrogen to facilitate dilution of cell off-gases, etc. Other duplicate openings for product removal, gas removal, instrument access and other purposes may also be provided if desired.

In FIG. 2 the relationship between the electrodes and entire anode and cathode assemblies in the lower housing of the cell are better illustrated than in FIG. 1, through enlargement of part of the drawing. However, because FIG. 3 provides a piecemeal breakdown of said electrodes and assemblies shown in FIGS. 1 and 2, no detailed description of FIG. 2 will be given, but instead the components therein will be referred to in conjunction with the description of FIG. 3.

Although the electrodes may be mounted advantageously through base plate 16 of the apparatus as, for example, by the method illustrated in copending application Ser. No. 104,231, it is most preferred to mount both anodes and cathodes 27 and 29 to the front and rear walls of housing 17, as shown in FIGS. 1 and 2 of the present application. According to the latter method the upwardly extending anodes and cathodes are installed through and mounted to the interior walls of the apparatus perpendicular to the cell's longitudinal axis, such that they are spaced from each other, and alternately and parallelly arranged.

FIG. 3 illustrates cathode backplate 38 at rear wall 28 of the lower housing with some cathodes 29 removed. Backplate 38 shown mounted to the lower housing may as one embodiment have a plurality optional longitudinal recesses 54 on the interior side of the plate, said recesses adapted to receive cathode and anode fingers 29 and 27. Recesses 54 are parallel to each other and machined at closely controlled distances, such that when the electrodes are in place, the gap or distance between alternating anodes and cathodes provides the lowest operating cell voltages at the highest current efficiencies. Comparable recesses on the interior side of the anode backplate 34 are not shown. Individual electrode fingers may be "permanently" affixed into recesses 54, as by welding. Alternatively, recesses 54 may be omitted and removable means utilized, such as clamping members welded to the interior side of the backplate with "sandwich"-like spacers for detachably mounting the electrodes with bolts or rivets. This latter embodiment is disclosed in copending application Ser. No. 104,231 which is incorporated-by-reference herein. Regardless of the method utilized for mounting the electrodes to their backplates both anode and cathode fingers are elevated above base plate 16, so the lower edges of the electrodes are not in contact with the bottom of the apparatus, thereby creating clearance space 49. Space 49 permits descending electrolyte from the funneling chimney to be recirculated upwardly through the electrodes according to the flow pattern shown by arrows 41 illustrated in FIGS. 1 and 2.

As a more preferred embodiment, FIG. 3 illustrates anode module 51 whereby anodes 27 are mounted to the anode backplate 34 by any of the foregoing methods. The electrode module may be installed or removed from front wall (anode side) of the lower housing as a single unit. The concept of electrode modules also applies to the cathode although it is not as well illustrated in FIG. 3. Backplate 34 is equipped with lugs 32 for receiving and connecting bus bar assembly 58, said assembly consisting of bus bar backplate 56 and bus 75 mounted perpendicular to backplate 56, said backplate equipped with matching holes 52 for receiving lugs 32 secured by lug nuts (not shown). Bus bar assembly 58 is in electrical contact with module assembly 51.

The anode fingers 27 of the assembly are inserted through the wall opening of the lower housing between the cathode fingers at predetermined distances creating the desired anode-cathode gap. The apparatus is sealed from leakage of electrolyte by compressing the module against gasket 66 by means of retaining bolts 74 (FIG. 2) through matching holes 60 and 62. The single gasket will reduce the incidence of cell leakage. The preferred electrode modules will also reduce costly down-time since easy accessibility of the electrodes permits installation of a back-up service module inventoried for stand-by use. Thus, production loss during servicing is minimized.

Figure 4:
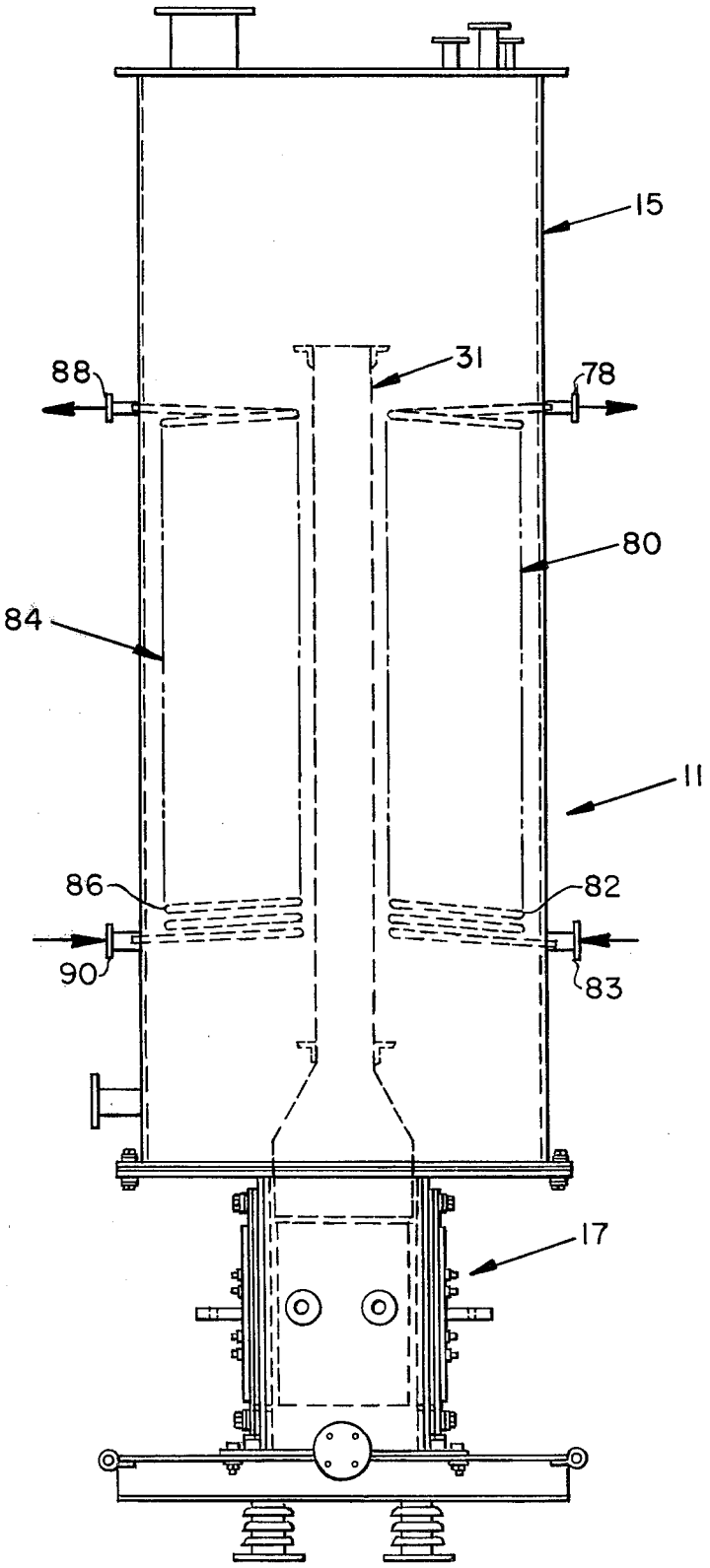
FIGS. 4 and 5 illustrate alternate embodiments of the apparatus of FIG. 1, including temperature controlling heat exchangers.
Figure 5:
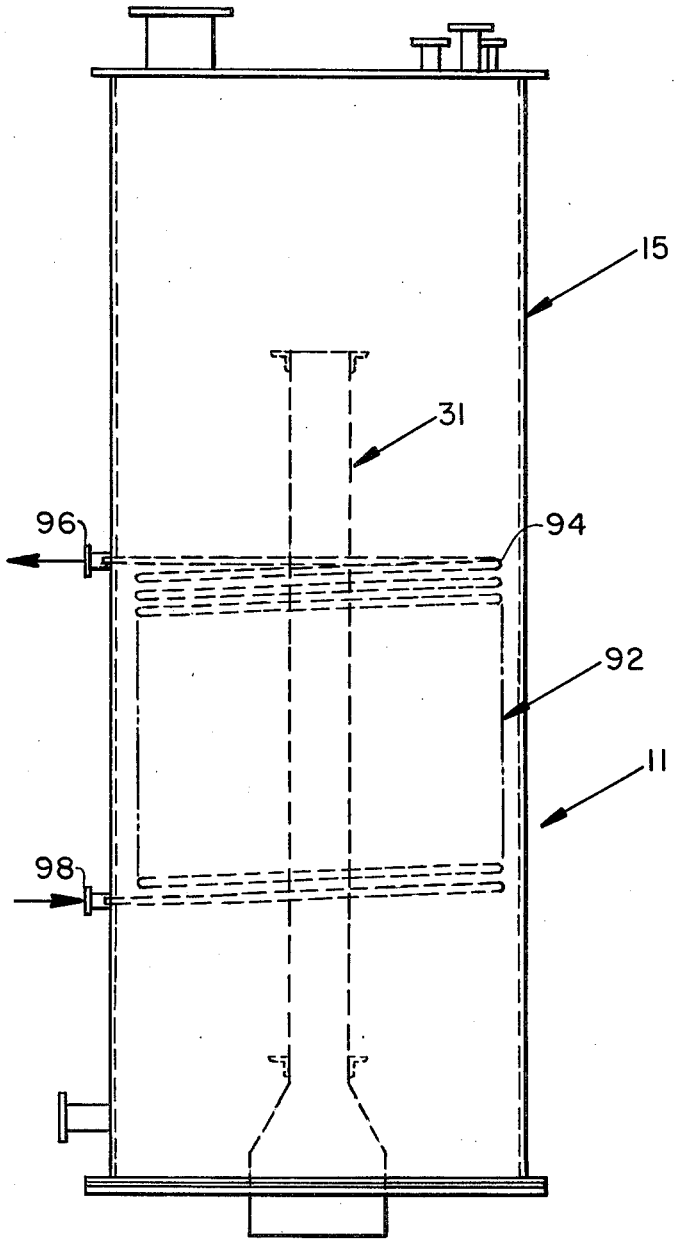

FIGS. 4 and 5 illustrate side-elevational views of the apparatus of FIG. 1, except means are included for maintaining the cell liquor at reduced temperatures especially when solutions of sodium chlorate such as R-2 are being made. To reduce electrolyte temperature and loss of water during cell operation one embodiment (FIG. 4) may consist of a plurality of heat exchangers 80 and 84 located in upper cylindrical housing 15, one on each side of funneling chimney riser 31. Coolant, such as water is circulated through inlet ports 83 and 90 exiting via outlets 78 and 88 of cooling coils 82 and 86. Operation of the coils is regulated with control valves of conventional design (not shown).

FIG.5 illustrates a further alternate embodiment of the apparatus of the present invention wherein a heat exchanger 92 consisting of a single cooling coil 94 is disposed between the interior side wall of upper housing 15 and chimney riser 31. Coolant is fed to the single coil through inlet 98 exiting at 96.

Figure 6:
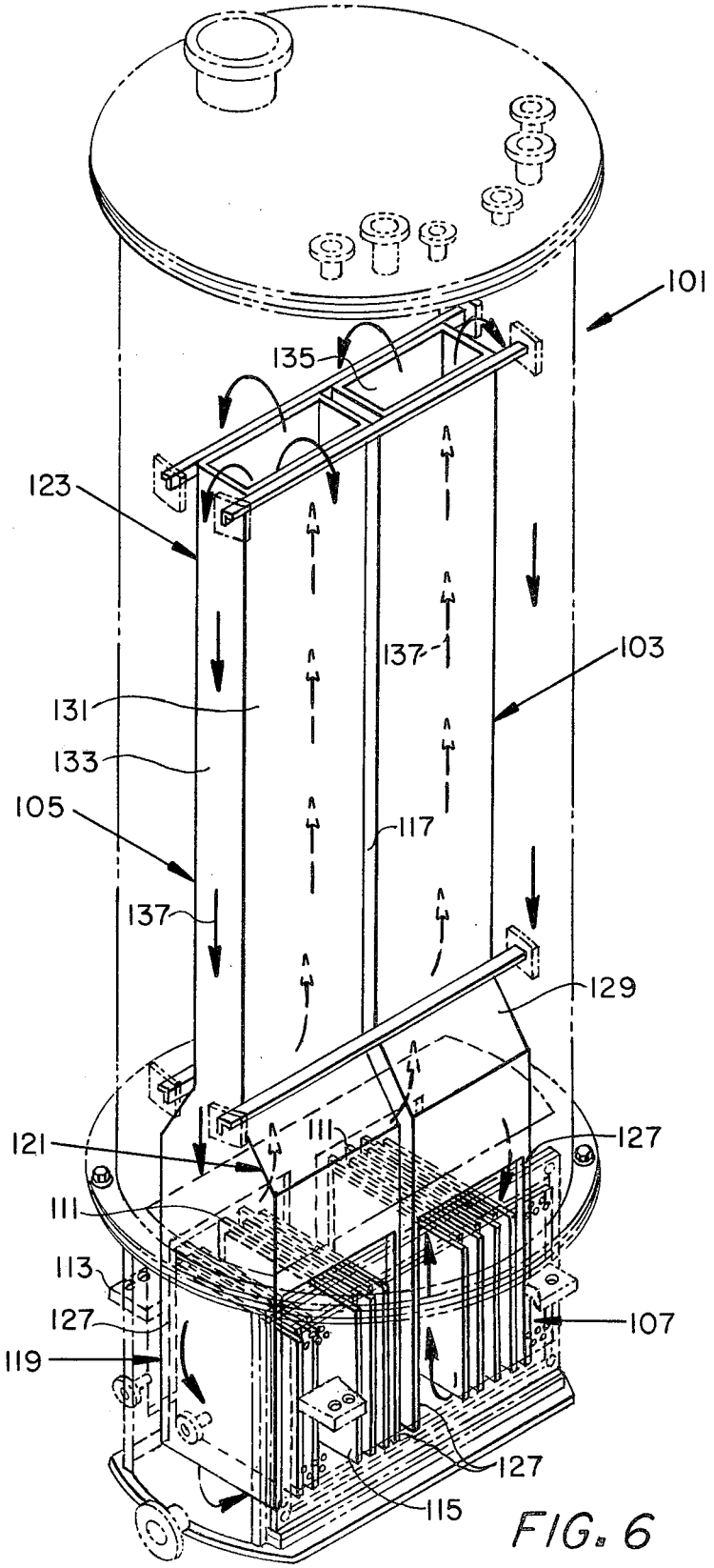
FIG. 6 is a perspective view of the apparatus of FIG. 1, including the oval or cylindrical shaped cell housing but showing a plurality of funneling chimneys of a modified type.

In FIG. 6 a different electrolytic cell apparatus 101 is illustrated, in which plural funneling chimney structures 103 and 105 are present, similar to but different from that of FIG. 1. However, because many details of both apparatus appear similar no specific descriptions of inlets, outlets, access openings and the like will be given herein, the descriptions thereof with respect to FIG. 1 being adopted. However, the interiors of the apparatuses are significantly different, despite the fact that they both include alternate arrangements of flat anodes and cathodes and funneling chimneys over them, designed to create desirable circulations of electrolyte and a sufficient hold-up time for hypochlorite to be converted to chlorate.

In apparatus 101 a plurality of cathodes 111 are illustrated, physically and electrically joined to cathode assembly 113. Anodes 115 are fitted between cathodes 111, leaving clearance spaces for electrolyte between the various anode and cathode surfaces. Anodes 115 are physically and electrically joined to anode assembly 107. Funneling chimneys 103 and 105 are each in position covering the anodes and cathodes in their areas of the apparatus, leaving a clearance 117 between the chimneys.

Because funneling chimney 103 is essentially the same as that designated 105 the following description of chimney 105 also applies to chimney 103. Funneling chimney 105 includes shrouding, reducing and passageway sections 119, 121, and 123, respectively. Shrouding section 119 includes lower portions of end walls 127. However, front and rear walls of shrouding 119 remain open for installation of anodes and cathodes. Reducing section 121 includes tapering surfaces 129 and the upper portions of ends 127. (Of course, these parts are duplicated but are only being described and illustrated with respect to single sections thereof). Passageway section 123 includes sides 131 and ends 133, with an opening 135 in the top thereof, for withdrawal of electrolyte-product-gas mixture from passageway 123. There is a sufficient clearance between the passageway and the interior of the top of the apparatus to allow flow of electrolyte out of the passageway without significant back pressure development. Thus, the area for flow of the fluid out of the passageway should be at least equal to the internal section of the passageway at the top thereof. Shroud portion 119 of funneling chimney 105 extends to the bottoms of anodes 115 and thereby regulates flow of the electrolyte-product mix past the electrodes. Thus, as the electrolysis proceeds, electrolyte, hypochlorite and hydrogen gas (and other gases and chemicals present) rise between the electrodes, due mostly to the low density of the gases, and are blended as they pass through the funneling portion of the chimney and up through the passageway, with the linear velocity in the passage being less than that of the electrolyte traveling past the electrodes, often being from 0.2 to 0.8 times such velocity. Thus, the electrolyte, containing chlorine, caustic, hypochlorite, hypochlorous acid and hydrogen, moves very quickly through the electrolytic space and then slows down in the funneling chimney, where the hydrogen bubbles coalesce to an extent, so that improved mixing is obtained in the chimney, especially in the upperpassage portion thereof. After spilling over of the liquid from the top of the passage and after removal of at least some of the gas from the apparatus, the electrolyte (including product) moves downwardly through the downcomer portion of the apparatus at a diminished rate, due to the much greater cross-sectional area of the apparatus section through which it is passing. This allows additional time for the hypochlorite present to be converted to chlorate, by what is essentially a time and temperature controlled rearrangement reaction wherein hypochlorous acid and hypochlorite react to form chlorate, preferably conducted at 80° to 110° C. Then, the electrolyte-product liquid mix flows upwardly past the electrodes for further electrolysis and production of more hypochlorite.

In the embodiment of the invention illustrated in FIG. 6, a pair of chimneys is present, each of which covers its own set of electrodes, but, if desired, only one such structure may be employed or a greater plurality thereof, e.g., 3 may be utilized. With the plurality of sets of unit cells, as illustrated, advantages obtained are in the blending of products from both sets to produce a more uniform chlorate solution in the apparatus, and in being able to employ smaller chimney structures (larger ones may require heavier constructions, etc.). Circulation of electrolyte will be as illustrated in FIG. 6 following the paths of arrows 137.

The materials of construction of the various components of the present invention are known to those familiar with the art and are available. The apparatus housing or enclosure may be of any suitable materials of construction, including titanium, polypropylene, chlorinated polyvinyl chloride coated steel, PTFE coated steel and titanium clad steel. The internal plate of the apparatus of FIG. 1 and the base plates may be of similar materials, with carbon steel usually preferred. The funneling chimney and shroud or skirt structures may preferably be fabricated from titanium metal, although fiberglass, polypropylene and similar materials are also satisfactory. Sometimes, it may be preferred to utilize fiberglass reinforced polymers for apparatus parts. Normally, anodes and cathodes may be of the same types as are usually employed in chlorate cells. For example, platinum-iridium coated titanium anodes and carbon steel cathodes are useful, although various other well-known anode and cathode materials may be used instead. One preferred coating on the titanium anode is a 70:30 platinum:iridium composition but such proportion may be varied and platinum-ruthenium, ruthenium dioxide and mixed oxides of ruthenium may also be employed. Such and other preferred anodes are those known in the trade as dimensionally stable anodes. The anodes and cathodes used may be in solid or mesh form, with the latter frequently being preferred, and with the preferred material of construction being steel. Various connectors, such as bus bar assemblies may be of titanium coated copper (highly preferred). Gaskets employed will preferably be of EPDM (polymer of ethylene propylene diamine monomer), PTFE, polychloroprene or silicone rubber but it is within the invention to utilize other synthetic organic polymers, providing that they are of sufficient sealing power (elastomeric polymers are preferably employed). Among such other suitable plastics are the polyurethanes, polyethylene, polypropylene and polyvinyl chloride. When EPDM is used (preferred), it is preferably peroxide cured.

The described apparatuses will usually operate at temperatures in the range of 10° to 110° C., preferably 70° to 105° C. and more preferably 80° to 105° C., at a difference of 2.3 to 4.5 or 5 volts, preferably 2.3 to 3 volts, and a current density in the range of 0.1 to 0.7 ampere/sq. cm., preferably 0.1 to 0.5, more preferably 0.1 to 0.3 ampere/sq. cm. of anode surface, most preferably of 0.2 to 0.3 ampere/sq. cm. The cells are preferably low current density cells of improved operating efficiencies. The charge of brine to the cell will normally be at a concentration of sodium chloride in the range of 180 to 350 g./l., preferably 180–320 g./l., and the concentration of sodium chlorate being removed will be in the range of 250 to 750 g./l., preferably 300 to 750 g./l., and most preferably about 300 to 700 g./l. Such chlorate solution will also usually contain from about 80 to 160 or 200 g./l. of sodium chloride, preferably 100 to 160 g./l. thereof and 0.5 to 10 g./l. of sodium hypochlorite, preferably 1 to 6 g./l. and more preferably 2 to 6 g./l. To improve cell operation it is desirable to have dichromate ion present and accordingly, the electrolyte may contain from 0.5 to 10 g./l. of $Na_2Cr_2O_7$, preferably 1.5 to 5 g./l., and often about 2.5 g./l. The desirable velocity in the passageway at the top of the funneling chimney structure, for best flow and mixing in that passage and in the reducing funnel portion, will often be in the range of 20 to 100 cm./second and may preferably be from 35 to 70 cm./sec.

Under the conditions described, an assay chlorate efficiency in the range of 90–99% is obtainable, with such efficiency usually being in the range of 93 to 98%. Such efficiencies can be obtained utilizing platinum-iridium or equivalent coatings on titanium, with the proportions of platinum and iridium being 7:3, and at operating temperatures up to about 98° C., above which the efficiencies may be diminished somewhat.

In a typical cell of a type shown in FIG. 1 (and also in FIG. 6) the desired ratio of the chimney passage velocity to the velocity in the surrounding volume of the apparatus will usually be from about 2.5:1 to 50:1, preferably being in the range of 2.5:1 to 10:1. Such velocity ratios result in good mixing of the electrolyte, product and gases in the chimney passage, so as to further promote reaction of unreacted components thereof, while yet allowing a holdup time in surrounding volume sufficient to allow conversion of hypochlorite to chlorate at a significant rate. Under the conditions of operation and with the apparatuses described it is found that the hydrogen produced contains less than 3% of oxygen on a volumetric basis, preferably less than 1.5% thereof, indicating that there is little undesirable electrolytic production of chlorate or halate and oxygen, and the proportions of other gases such as chlorine, carbon dioxide and nitrogen are smaller yet.

In an apparatus like that illustrated in FIG. 1, measuring five meters in height by 1.4 m. in diameter wherein the funneling chimney is about 2.8 m. high and the passage thereof is about 0.2 m. wide and one m. in length is equipped with 81 anodes and 80 cathodes, taking 100,000 amperes current flow at a voltage of about 2.8 volts and operating 330 days per year, 24 hours per day, about five hundred metric tons per year of sodium chlorate will be produced. The flow rate through the chimney passage during such operation will usually be in the range of about 4,000 to 6,500 liters per minute at a temperature in the range of 80° to 110° C., and such a rate is obtainable without the need for pumping equipment. It will be seen that this rate is equivalent to about 1 to 2 volume changes per minute but from 0.3 to 5 changes will also be workable, depending on the circumstances.

Low current density chlorate cells of the present types are advantageous for many reasons, several of which have already been mentioned. Primarily, utilizing simple structures, comparatively easy to fabricate, install and service, they make it possible to produce halates efficiently and economically. Incidentally, "halate" is intended to cover chlorates of sodium and potassium, and other operative cations, and the bromates and iodates to the extent operative. The massing of a multiplicity, usually from 10 to 100 electrodes under a single collector structure saves complex fabrication of individual chimneys covering as few as two to eight electrodes and makes the chimney passage less liable to become blocked with sediment, corrosion products and foreign matter. that may have entered the apparatus. The funneling structure and the reduced cross-sectional area chimney communicating with it, result in a desirable mixing of the chlorine and caustic which becomes chlorine, hypochlorous acid and hypochlorite, promoting reaction thereof; yet, the larger of the apparatus, which slows the flow of liquid, facilitates chlorate production from the hypochlorite and hypochlorous acid. Hydrogen gas, which is withdrawn at the top of the apparatus, promotes the flow and intermixing of the reactants in the area between the electrodes and in the funneling chimney but, because it is withdrawn at the top of the apparatus, does not interfere with the production of chlorate from hypochlorite. The flow paths illustrated in the drawing, with respect to the embodiments of the invention shown in FIGS. 1, 4, 5 and 6, assure that there will be no undesirable intermixing of electrolytes, with no downward flow being between the electrodes, and also assure that the electrolyte will continuously be recycled upwardly past such electrodes, at a desired velocity and without any "dead" locations in the apparatus, which could result in oxygen generation, electrolytic production of chlorate and efficiency losses. Due to the construction of the described apparatuses it will be clear that leakage through multiplicities of gaskets around conductors to individual electrodes will be minimized. Furthermore, disassembly and servicing of the apparatuses is facilitated by the described structures. For example, with respect to the apparatus of FIG. 1, servicing may be effected easily by merely disconnecting bolts from the electrode modules which permits removal of the electrodes for replacement or repair. The prevention of product leakage is important because with many chlorate apparatuses excessive time is spent in replacing gaskets, especially where the anode conductors enter the apparatus. The present method eliminates multiple seals thereby reducing the number of possible leakage points. Power costs are lowered in the present invention by accurate location of the anode material at a desirable close distance from the cathode material, using low current density and thereby reducing the voltage. Electrode costs are reduced because no bends are needed in the anode material, thereby facilitating easier recoating of electrodes and eliminating some of the more costly components of such apparatuses, e.g. multiplicities of titanium clad copper conductor rods and titanium reinforcements. Also, the internal structure of the cell facilitates replacement of the cathodes as they wear out, usually due to corrosion or hydrogen blistering. The cell construction is simplified and closer tolerances can be met without employing time-consuming methods, normally required for electrolytic cell renewals. Another advantage is in the interchangeability of the apparatuses of the different types shown in FIGS. 1 and 6.

Various modifications of the invention may be employed, some of which have been alluded to previously. Thus, as in FIG. 6, wheren a plurality of chimneys is present in the apparatus, so too can a plurality of the chimneys of FIG. 1 be utilized, if desired. The chimney structure, in the funneling portion thereof, may be further modified to diminish longitudinally and upwardly, as well as transversely and upwardly or may diminish only longitudinally and upwardly. Also, the passage portion may diminish longitudinally and upwardly. However, such constructions are not preferable and do not appear to result in the most desirable fluid flow. The distances between the chimneys and passages of the plurality of funneling chimneys of FIG. 6 may be modified but normally such distances will be only small percentages, e.g. 2 to 20%, preferably 2 to 7% of the total longitudinal lengths of the passages between which the clearances are located. In some cases, no clearances may be present between the different funneling chimneys of FIG. 6. The funneling portions of the funneling chimneys may be suitably curved, rather than straight walled and similarly, the shapes of various other parts of the apparatus may be changed. The locations of openings in the apparatus for the additions and removals of materials may be altered. The shapes of internal passageways in the plate between the upper and lower housing sections of the apparatus of FIG. 1 may be changed, as may be the open area thereof but normally such area will be 50 to 95% of that available between the end walls of the funneling chimney and those of the apparatus. The shapes of the electrodes may be altered so that the shape of the passageway under the electrodes for flow of electrolyte to positions where it may move upwardly between the electrodes may also be altered but normally a rectangular shape, such as that illustrated, is highly preferred. If velocities are too low from gas effects alone a supplementing pump may be employed but this is usually neither necessary nor even desirable. Various other modifications of the apparatus may also be made, without departing from the teachings herein.

The process aspect of this invention will now be described in the following examples. However, it must be understood that the examples are only given as illustrative, and the invention is not limited to them. All temperatures in this specification are in °C. and all parts are by weight, unless otherwise indicated.

EXAMPLE 1

An apparatus of the type illustrated in FIGS. 4 or 5 is utilized having one or two cooling coils, with the housing measuring approximately 5.2 meters (height) by 1.4 meters (diameter). The cooling coils may best be used to make R-2 solution containing about 330–340 gpl sodium chlorate and about 190–200 gpl sodium chloride, since a crystalline product is not preferred with this method of operation, e.g. cooling coil. Selection of proper brine feed rate and salt concentration will yield R-2 solution directly from this embodiment of the invention. The various other structural parts thereof are approximately to scale but 81 anodes and 80 cathodes are employed. The anodes are dimensionally stable anodes, having a platinum-iridium coating over a titanium base, with the percentages of platinum and iridium being 70% and 30% in the coating. The cathodes are of low carbon steel. The anodes and cathodes are modular units which facilitate maintenance.

The electrolyte charged to the cell is a brine, having about 300 (290–320) g./l. of sodium chloride in water and also containing about 2 g./l. of sodium dichromate. Before charging the electrolyte the cell is purged with nitrogen and such purging may also be effected while the electrolyte is being added and afterward. The apparatus is operated at a current density in the range of 0.12 to 0.68 ampere/sq. cm., with the current density for most of the operation being about 0.2 ampere/sq. cm. so that the voltage is in the range of 2.5 to 4.5 volts. The flow velocity past the electrodes and up the passageway of the funneling chimney is in the range of 40 to 70 cm./sec. and the temperature of operation is in the range of 70° C. to 98° C. The flow of water through the dual cooling coils (FIG. 4) is ~13 gpm with a $\Delta P$ of 60 psig, an entering temperature of 25° C. and exit temperature of 48° C. through each of the coils with the cell operating at ~95° C. The flow of water through the single cooling coil (FIG. 5) is 21 gpm with $\Delta P$ of 60 psig, with an entering temperature of 25° C. and an exit temperature of 40° C. with the cell operating at 95° C. The flows of electrolyte range from 4,000 to 6,000 liters/minute and the cell is operated steadily. During operation measurements are made of flow rates and it is found that at 70° C. a velocity of 49 cm./sec. is obtained, corresponding to 4,900 l./min. At 90° C. such velocity is 55 cm./sec., corresponding to 5,500 l/min. At 98° C. the velocity is 59 cm./sec. and the flow rate is 5,900 l/min. At such condition the assay chlorate efficiency is in the range of 95 to 98%. At 95° C. the velocity is 57 cm./sec., corresponding to 5,700 l./min. The chlorate production rate is about 70,000 tons per year, calculated on the basis of a 24 hours per day operation for 330 days per year, in a plant having 140 such apparatuses operating. The product obtained may have a concentration of sodium chlorate in the range of about 330 (R-2 concentration) to 700 g./l. depending on the concentration desired, with the sodium chloride content being from 80 to 200 g./l. (the latter being R-2 concentration) and the sodium hypochlorite content being from 2 to 6 g./l. For example, operating at 90° C., the sodium chlorate concentration is about 550 g./l., the sodium chloride concentration is about 125 g./l., the sodium hypochlorite concentration is about 4 g./l. and the oxygen content of the hydrogen taken off is less than 2.5% by volume.

EXAMPLE II

An apparatus of the type illustrated in FIGS. 1, 2, 3 and 6 is utilized, with the housing measuring approximately 5.2 meters (height) by 1.4 meters (diameter). The various structural points thereof are approximately to scale. 81 anodes and 80 cathodes are employed. The anodes are dimensionally stable anodes, having a platinum-iridium coating over a low-iron titanium substrate with Pt:Ir ratio of 7:3 in the noble metal coating. The cathodes are of low carbon steel and both anodes and cathodes are of modular construction to facilitate interchangeability and maintenance.

The electrolyte charged to the cell is brine, having about (180–200 gpl) 190 gm./l of sodium chloride in water and also containing about 5 gm./l sodium dichromate. Before charging the electrolyte, the cell is purged with nitrogen and such purging may also be effected while the electrolyte is being added and afterward. The apparatus is operated so that the current flow is about 100,000 amperes and the current density is in the range of 0.12 A/cm$^2$ to 0.23 A/cm$^2$, with the current density for most of the operation being about 0.2 A/cm$^2$ so that the voltage is in the range of 2.4 to 3 volts. The flow velocity past the electrodes and up the passageway of the funneling chimney is in the range of 60–70 cm./sec. and the temperature of the operation, 102° C. to 108° C. The system is adiabatic (operates without cooling (fluid) other than air). The flow of electrolyte ranges from 6,000–6,500 l./min. and the cell is operated steadily. During operation @ 102° C., the velocity is 61 cm./sec., corresponding to 6,100 l./min. and at 105° C. the velocity is 64 cm./sec., corresponding to 6,300 l./min. and at 108° C., the velocity is 68 cm./sec., corresponding to 6,500 l./min. The brine flow rate is 23.6 l./hr. of 190 gm./l. NaCl at 105° C. (preferred operating temperature) providing a product having 600 gpl $NaClO_3$ and 106 gpl NaCl, a liquid product which crystalizes at 35° to 40° C. The advantage being that a minimal amount of energy is required to crystallize the sodium chlorate when the cell is run in an adiabatic mode without use of internal or external cooling means with exception to ambient air. The assay chlorate efficiency ranges from 93–97%.

The invention has been described with respect to various embodiments and illustrations thereof but is not to be limited to these because it is clear that one of skill in the art, with the present specification before him, will be able to utilize substitutes and equivalents without departing from the invention.

What is claimed is:

1. An electrolytic apparatus for the production of alkali metal halate from an electrolyte comprising an aqueous solution of an alkali metal halide, the apparatus comprising a substantially cylindrically shaped upper housing section and a substantially rectangular shaped lower housing section, said upper housing superimposed over the lower housing section; electrodes comprising a plurality of upwardly, parallelly, alternating anodes and cathodes mounted to the side walls of the lower housing such that the products of electrolysis at the anodes and cathodes are in contact in the electrolyte between the electrodes where they can react to form hypohalite; a singular upwardly oriented flow directing funneling chimney structure located principally in the upper housing section extending over the electrodes and narrowing down to a passageway at an angle sufficient to maximize gas lift flow through which the hypohalite-containing electrolyte rises from the lifting power of hydrogen generated from between pairs of the electrodes during electrolysis, said electrolyte being mixed in the passageway, the upper housing having means for removing at least a portion of the hydrogen exiting from the passageway, said upper and lower housing sections including internal voids or clearances at housing ends and between the passageway and housing walls adapted so that electrolyte spilling over the top of the passageway moves downwardly through said voids or clearances in a direction parallel to the longitudinal axis of the cell and then moving transversally at the bottom of the cell for recirculation upwardly through the electrodes and chimney structure, said apparatus including means for feeding electrolyte thereto and halate removal therefrom.

2. The apparatus of claim 1 wherein the anodes and cathodes are mounted to backplates forming unitized electrode modules.

3. The apparatus of claims 1 or 2 including a heat exchanger for removing heat from electrolyte.

4. The apparatus of claim 3 wherein the heat exchanger comprises at least one cooling coil.

5. The apparatus of claims 1 or 2 with a plurality of funneling chimney structures.

6. The apparatus of claim 5 including at least one cooling coil.

7. The apparatus of claim 1 wherein the funneling chimney is coextensive with the anode and cathode combinations, covering said combinations and narrowing down at an angle of between 45° and 95° to form a passageway of uniform cross-section.

8. The apparatus of claim 1 wherein the passageway is centrally located with respect to the funneling chimney structure and such structure includes tapered sides for narrowing down the path of electrolyte and gas to the passageway.

9. The apparatus of claim 8 wherein the funneling chimney narrows to a passageway which extends over some of the electrodes and is of horizontal cross-sectional area which is 10 to 40% of the horizontal cross-sectional area of the funneling chimney at its widest part.

10. The apparatus of claim 8 wherein the funneling chimney structure includes skirt portions extending downwardly from the chimney side walls into the lower housing.

11. A method of manufacturing alkali metal chlorate which comprises applying a current to an aqueous solution of alkali metal chloride in an electrolytic apparatus to produce mainly chlorine, alkali metal hypochlorite, hypochlorous acid and hydrogen of which chlorine and alkali metal hypochlorite, hypochlorous acid and hydrogen react in-situ converting a substantial part of the hypochlorite to alkali metal chlorate, said apparatus comprising a substantially cylindrically shaped upper housing and a substantially rectangular shaped lower housing, said upper housing superimposed over the lower housing; electrodes comprising a plurality of upwardly, parallelly alternating anodes and cathodes mounted to the side walls of the lower housing section such that the products of electrolysis at the anodes and cathodes are in contact in the electrolyte between the electrodes where they can react to form hypochlorite; at least one upwardly oriented flow directing funneling chimney structure located principally in the upper housing section extending over the electrodes and narrowing down to a passageway at an angle sufficient to maximize gas lift flow through which the hypochlorite-containing electrolyte rises from the lifting power of the hydrogen generated therein, said electrolyte being mixed in the passageway; the upper housing section having means for removing at least a portion of the hydrogen exiting from the passageway, said upper and lower housing sections including internal voids or clearances at housing ends and between the passageway and housing walls adapted so that electrolyte spilling over the top of the passageway moves downwardly through said voids or clearances in a direction parallel to the longitudinal axis of the cell and then moving transversally at the bottom of the cell for recirculation upwardly through the electrodes and chimney structure, said apparatus including means for feeding electrolyte thereto and halate removal therefrom.

12. The method of claim 11 wherein the anodes and cathodes of the apparatus are mounted to backplates forming unitized electrode modules.

13. The method of claim 11 wherein the apparatus includes at least one heat exchanger consisting of a cooling coil.

14. The method of claim 11 wherein the funneling chimney narrows down at an angle of between 45° and 95° to form a passageway of uniform cross-section.

15. The method of claim 11 wherein the passageway is centrally positioned with respect to the funneling chimney and such structure includes tapered sides for narrowing down the path for electrolyte and gas to the passageway.

* * * * *